US011131113B2

(12) United States Patent
Feng et al.

(10) Patent No.: US 11,131,113 B2
(45) Date of Patent: Sep. 28, 2021

(54) FENCE RAIL DEVICE

(71) Applicant: BODO Plastics Company LTD, Zibo (CN)

(72) Inventors: Sun Feng, Zibo (CN); Zhou Xuewei, Zibo (CN)

( * ) Notice: Subject to any disclaimer, the term of this patent is extended or adjusted under 35 U.S.C. 154(b) by 324 days.

(21) Appl. No.: 16/372,518

(22) Filed: Apr. 2, 2019

(65) Prior Publication Data

US 2020/0318383 A1 Oct. 8, 2020

(51) Int. Cl.
*E04H 17/16* (2006.01)
*E04H 17/14* (2006.01)

(52) U.S. Cl.
CPC ..... *E04H 17/165* (2013.01); *E04H 17/1439* (2013.01); *E04H 17/1447* (2021.01); *E04H 17/1465* (2021.01); *E04H 17/1486* (2021.01)

(58) Field of Classification Search
CPC ..... E04H 17/1417; E04H 17/1426; E04H 17/1439; E04H 17/165
USPC ..... 256/59
See application file for complete search history.

(56) References Cited

U.S. PATENT DOCUMENTS

D348,525 S * 7/1994 Dallaire ..... D25/123
6,595,497 B1 * 7/2003 Linford ..... E04H 17/1417 256/19
7,934,699 B2 5/2011 Zell
9,476,220 B2 10/2016 Williams, Sr.
2003/0038282 A1 * 2/2003 Forbis ..... E04H 17/16 256/65.1
2006/0180802 A1 * 8/2006 Forbis ..... E04H 17/1417 256/24
2008/0135823 A1 * 6/2008 Amendola ..... E04H 17/16 256/59
2008/0142772 A1 6/2008 Amendola
2008/0179578 A1 * 7/2008 McGinness ..... E04F 11/1812 256/59
2008/0179580 A1 * 7/2008 McGinness ..... E04H 17/16 256/59
2009/0078923 A1 3/2009 McGinness
2010/0096608 A1 * 4/2010 McCarthy ..... E04H 17/16 256/19
2012/0319067 A1 12/2012 Millar
2016/0066536 A1 3/2016 Fitzgerald
2018/0073297 A1 3/2018 Wright
2019/0323259 A1 * 10/2019 DeLuso ..... E06B 3/9687

FOREIGN PATENT DOCUMENTS

AU 2012216706 3/2013
AU 2013100109 3/2013
CN 203383680 1/2014

* cited by examiner

*Primary Examiner* — Joshua T Kennedy

(57) ABSTRACT

A fence rail device includes a rail elongated between a first end and a second end. The rail has an outer wall having a top section, a pair of side sections, and a bottom section defining a hollow interior. The slot extends through the bottom section. A plurality of cross walls includes a top cross wall, a middle cross wall, and a bottom cross wall defining a top interior space, a bottom interior space, an upper middle interior space, and a lower middle interior space within the rail. Each of a pair of lower interior walls extends between the bottom section and the bottom cross wall proximate to a respective one of the side sections. Each of a pair of medial interior walls extends between the bottom cross wall and the lower middle cross wall.

12 Claims, 4 Drawing Sheets

10
14
76

18
12

78
78
20
16
82
76
80
78
82
84
76
12
14
10
84
18
76
16
20

FENCE RAIL DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to fence rail devices and more particularly pertains to a new fence rail device for facilitating construction and enhancing durability of a fence construction.

(2) Description of Related Art Including Information Disclosed Under 37 CFR 1.97 and 1.98.

The prior art relates to fence rail devices.

BRIEF SUMMARY OF THE INVENTION

An embodiment of the disclosure meets the needs presented above by generally comprising a rail elongated between a first end and a second end. The rail has an outer wall having a top section, a pair of side sections, and a bottom section defining a hollow interior. The slot extends through the bottom section. A plurality of cross walls includes a top cross wall, a middle cross wall, and a bottom cross wall defining a top interior space, a bottom interior space, an upper middle interior space, and a lower middle interior space within the rail. Each of a pair of lower interior walls extends between the bottom section and the bottom cross wall proximate to a respective one of the side sections. Each of a pair of medial interior walls extends between the bottom cross wall and the lower middle cross wall.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figures 1, 2:
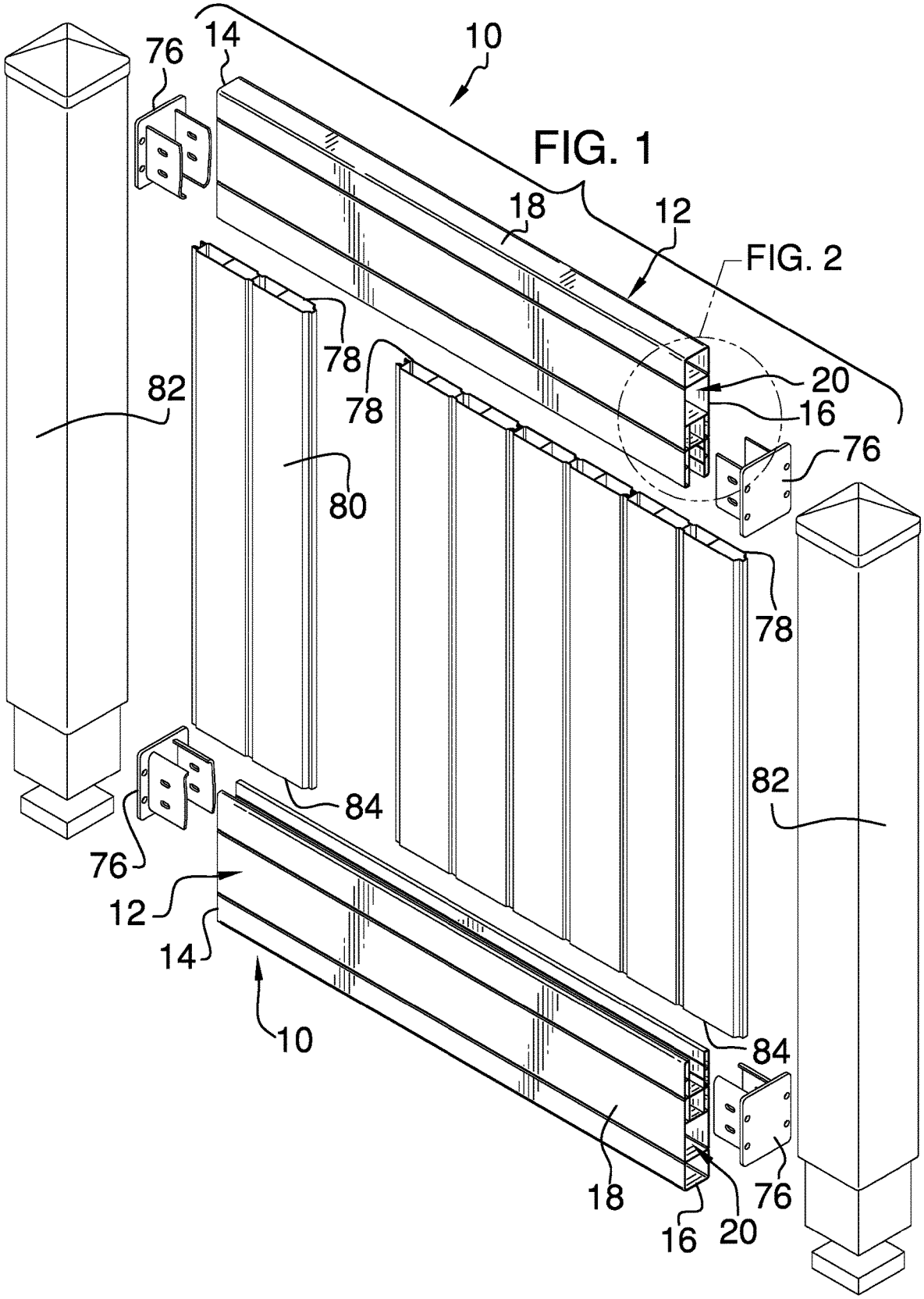
FIG. 1 is a top front side perspective view of a fence rail device according to an embodiment of the disclosure.
FIG. 2 is a detailed top front side perspective view of an embodiment of the disclosure as indicated in FIG. 1.
Figure 2:
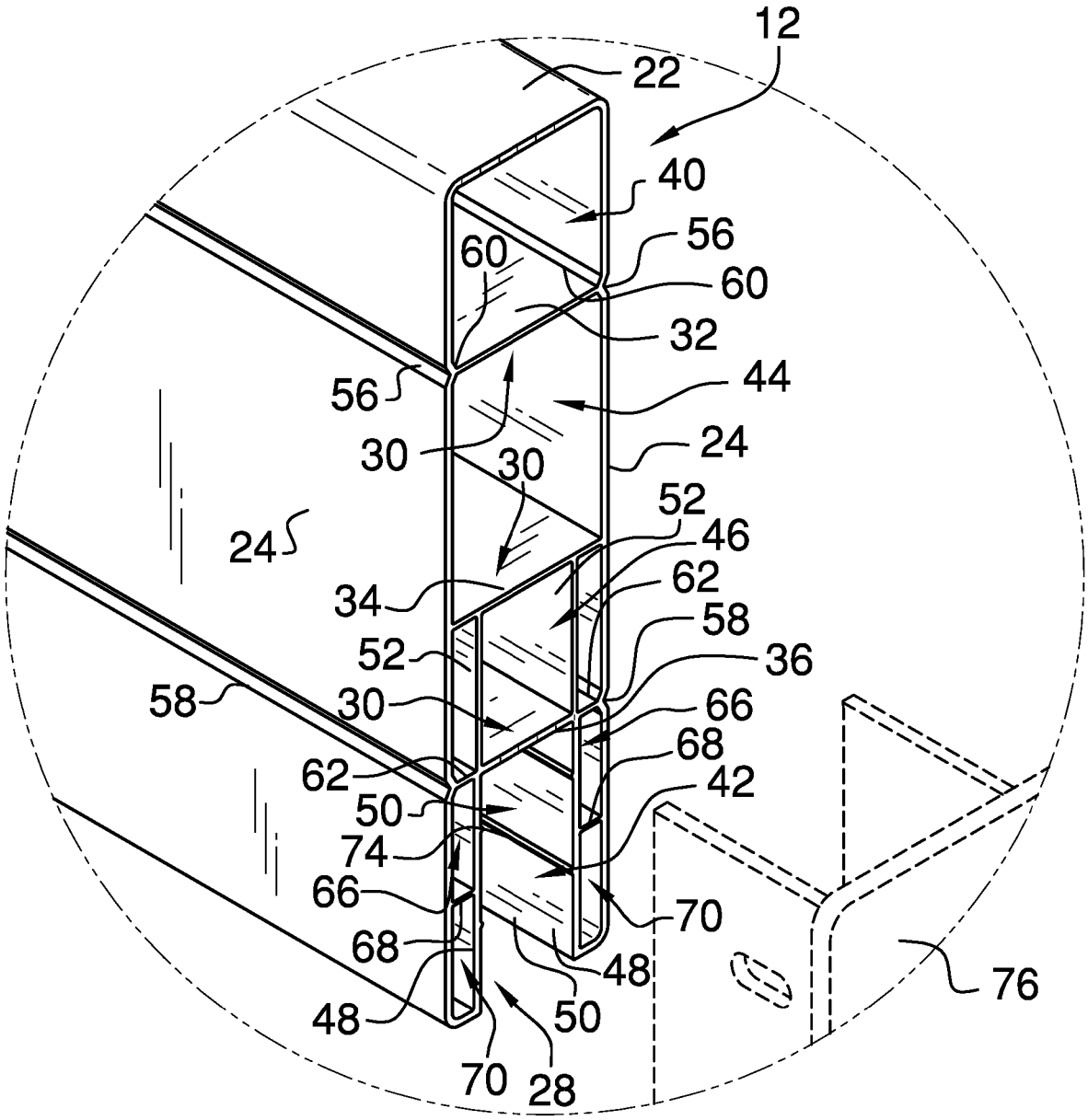
Figure 3:
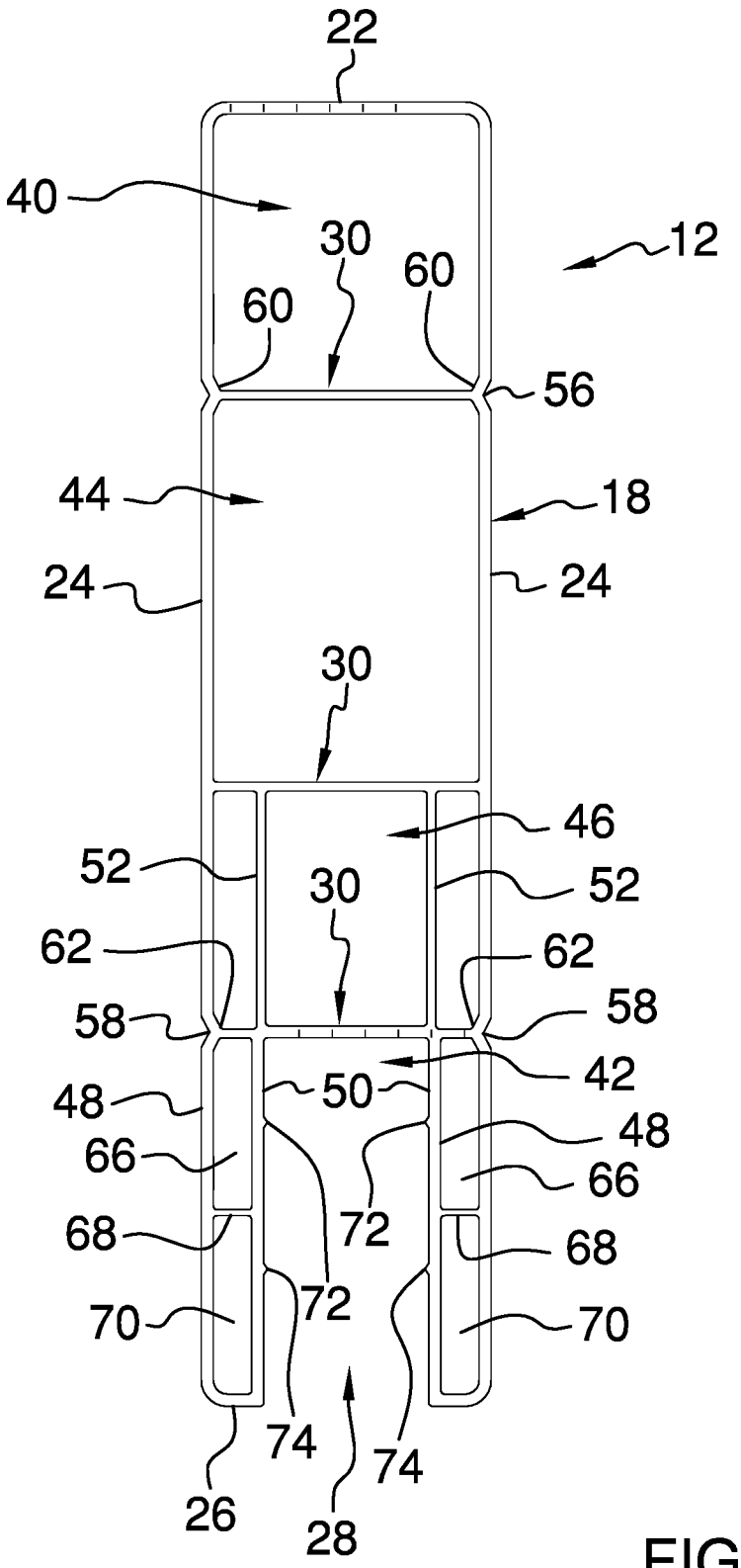
FIG. 3 is a left side end view of an embodiment of the disclosure.
Figure 4:
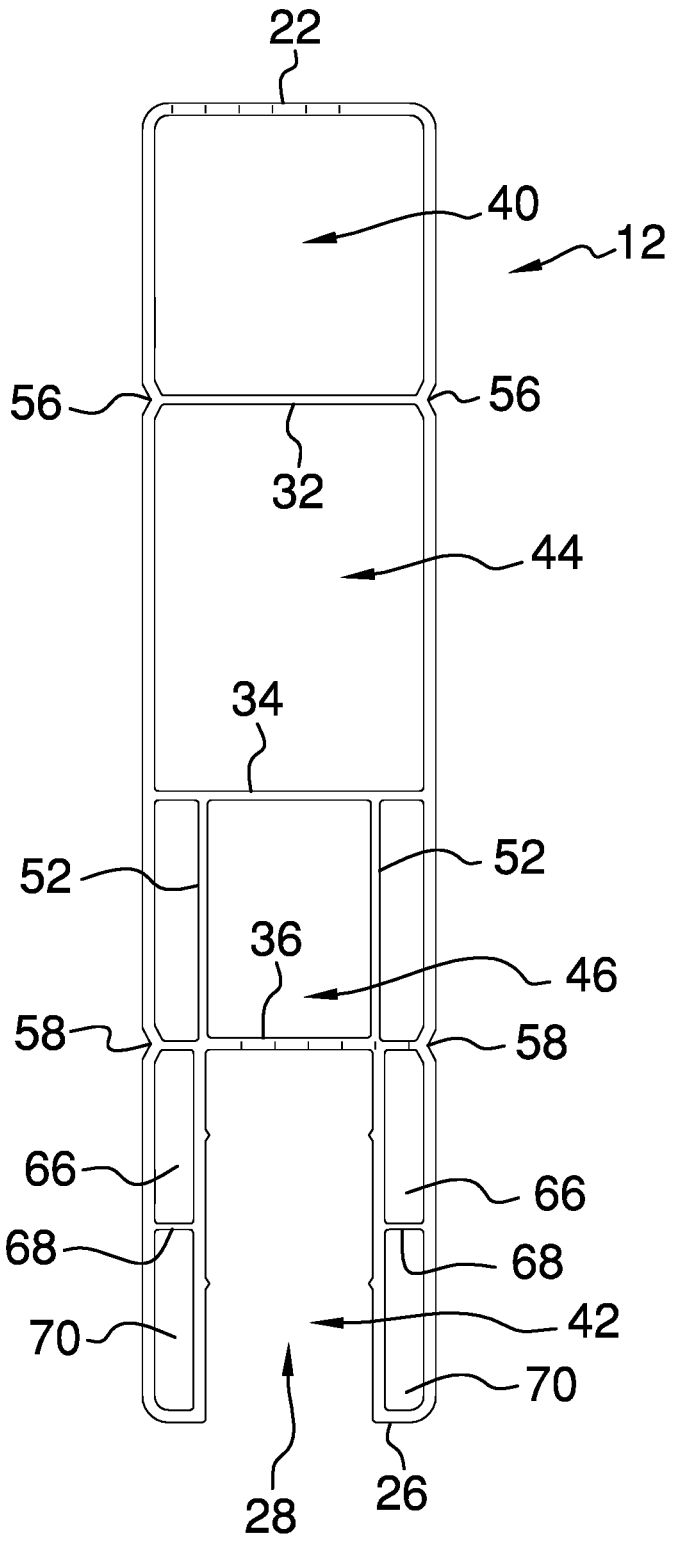
FIG. 4 is a right side end view of an embodiment of the disclosure.

With reference now to the drawings, and in particular to FIGS. 1 through 4 thereof, a new fence rail embodying the principles and concepts of an embodiment of the disclosure and generally designated by the reference numeral 10 will be described.

As best illustrated in FIGS. 1 through 4, the fence rail device 10 generally comprises a rail 12. The rail 12 has a first end 14 and a second end 16. The rail 12 is elongated between the first end 14 and the second end 16. The rail 12 comprises an outer wall 18 defining a hollow interior 20 extending between the first end 14 and the second end 16. For purposes of description the rail 12 is described relative to the orientation shown at the top of FIG. 1. The outer wall 18 has a top section 22, a pair of side sections 24, and a bottom section 26. The side sections 24 are parallel to each other and are substantially planar except as described below. Transitions or corners between the top section, side sections, and bottom section may be rounded. A slot 28 extends through the bottom section 26 between the first end 14 and the second end 16.

Each of a plurality of cross walls 30 is planar. Each of the cross walls 30 extends between the side sections 24. The plurality of cross walls 30 includes a top cross wall 32, a middle cross wall 34, and a bottom cross wall 36. The top cross wall 32 is spaced from the top section 22 of the outer wall 18 to define a top interior space 40 within the outer wall 18. The bottom cross wall 36 is spaced from the bottom section 26 to define a bottom interior space 42. The middle cross wall 34 is positioned between the top cross wall 32 and the bottom cross wall 36 to define an upper middle interior space 44 above the middle cross wall 34 and a lower middle interior space 46 below the middle cross wall 34. The middle cross wall 34 is positioned closer to the bottom cross wall 38 than to the top cross wall 32. A distance between the top cross wall 32 and the top section 22 is less than a distance between the bottom cross wall 36 and the bottom section 26.

Each of a pair of lower interior walls 48 is coupled to and extends between the bottom section 26 and the bottom cross wall 36. Each of the lower interior walls 48 is positioned proximate to a respective one of the side sections 24. Each of the lower interior walls 48 is aligned with and defines a respective lateral side 50 of the slot 28. Each of a pair of medial interior walls 52 is coupled to and extends between the bottom cross wall 36 and the middle cross wall 34. A distance between the medial interior walls 52 is less than a distance between the lower interior walls 48.

Each of a pair of upper grooves 56 extends into a respective one of the side sections 24 of the outer wall 18 of the rail 12. Similarly, a pair of lower grooves 58 extends into a respective one of the side sections 24 of the outer wall 18 of the rail 12. Each of the side sections 24 has a constant thickness wherein each of the upper grooves 56 defines a corresponding upper interior ridge 60 within the hollow interior 20 and each of the lower grooves 58 defines a corresponding lower interior ridge 62 within the hollow interior 20. Each of the upper interior ridges 60 is coplanar with the top cross wall 32. Each of the lower interior ridges 62 is positioned coplanar with the bottom cross wall 36.

Each of a pair of dividers 68 is coupled to and extends between a respective one of the lower interior walls 48 and a respective one of the side sections 24 to divide the bottom interior space 42 on opposite sides of the slot 28 into respective upper portions 66 and lower portions 70.

Each of a pair of upper slot ridges 72 extends from a respective one of the lower interior walls 48 into the slot 28. Each of a pair of lower slot ridges 74 extends from a respective one of the lower interior walls 48 into the slot 28 spaced and parallel to the upper slot ridges 72.

In use, the described positional relationships and structures enhance stiffness and connection of the rail 12 to end supports 76. The rail 12 is one of a pair of rails 12 having the same structure as described above. The slot 28 of one rail 12 receives and covers the top 78 of panels 80. The fence rail device 10 is described above in the orientation for a top rail position. A second rail 12 is used and is inverted as shown at the bottom of FIG. 1. The slot 28 receives the bottom end 84 of the panels 80 using end supports 76, also in an inverted position. In combination with fence posts 82, panels 80, and the end supports 76, the fence rail device 10 facilitates construction of a durable fence structure.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A fence rail device comprising:

a rail, said rail having a first end and a second end, said rail being elongated between said first end and said second end, said rail comprising an outer wall defining a hollow interior extending between said first end and said second end, said outer wall having a top section, a pair of side sections, and a bottom section, said side sections being parallel to each other, said side sections being substantially planar;

a slot extending through said bottom section between said first end and said second end;

a plurality of cross walls, each of said cross walls being planar, each of said cross walls extending between said side sections, said plurality of cross walls including a top cross wall, a middle cross wall, and a bottom cross wall, said top cross wall being spaced from said top section of said outer wall to define a top interior space within said outer wall, said bottom cross wall being spaced from said bottom section to define a bottom interior space, said middle cross wall being positioned between said top cross wall and said bottom cross wall to define an upper middle interior space above said middle cross wall and a lower middle interior space below said middle cross wall;

a pair of lower interior walls, each of said lower interior walls being coupled to and extending between said bottom section and said bottom cross wall, each of said lower interior walls being positioned proximate to a respective one of said side sections;

a pair of medial interior walls, each of said medial interior walls being coupled to and extending between said bottom cross wall and said lower middle cross wall;

a pair of upper grooves, each of said upper grooves extending into a respective one of said side sections of said outer wall of said rail;

each of said side sections having a constant thickness wherein each of said upper grooves defines a corresponding upper interior ridge within said hollow interior; and each of said upper interior ridges being coplanar with said top cross wall.

2. The device of claim 1, further comprising said middle cross wall being positioned closer to said bottom cross wall than said top cross wall.

3. The device of claim I, further comprising each of said lower interior walls being aligned with and defining a respective lateral side of said slot.

4. The device of claim 1, further comprising a distance between said medial interior walls being less than a distance between said lower interior walls.

5. The device of claim 1, further comprising a pair of lower grooves, each of said lower grooves extending into a respective one of said side sections of said outer wall of said rail.

6. The device of claim 5, further comprising each of said side sections having a constant thickness wherein each of said lower grooves defines a corresponding lower interior ridge within said hollow interior.

7. The device of claim 1, further comprising a pair of dividers, each of said dividers being coupled to and extending between a respective one of said lower interior walls and a respective one of said side sections to divide said bottom interior space on opposite sides of said slot into respective upper portions and lower portions.

8. The device of claim 1, further comprising a pair of upper slot ridges, each of said upper slot ridges extending from a respective one of said lower interior walls into said slot.

9. The device of claim 1, further comprising a pair of lower slot ridges, each of said lower slot ridges extending from a respective one of said lower interior walls into said slot.

10. The device of claim 1, further comprising a distance between said top cross wall and said top section being less than a distance between said bottom wall and said bottom section.

11. A fence rail device comprising:

a rail, said rail having a first end and a second end, said rail being elongated between said first end and said second end, said rail comprising an outer wall defining a hollow interior extending between said first end and said second end, said outer wall having a top section, a pair of side sections and a bottom section, said side sections being parallel to each other, said side sections being substantially planar;

a slot extending through. said bottom section between said first end and said second end;

a plurality of cross walls, each of said cross walls being planar, each of said cross walls extending between said side sections, said plurality of cross walls including a top cross wall, a middle cross wall, and a bottom cross wall, said top cross wall being spaced from said top section of said outer wall to define a top interior space within said outer wall, said bottom cross wall being spaced from said bottom section to define a bottom interior space, said middle cross wall being positioned between said top cross wall and said bottom cross wall to define an upper middle interior space above said middle cross wall and a lower middle interior space below said middle cross wall;

a pair of lower interior walls, each of said lower interior walls being coupled to and extending between said bottom section and said bottom cross wall, each of said lower interior walls being positioned proximate to a respective one of said side sections;

a pair of medial interior walls, each of said medial interior walls being coupled to and extending between said bottom cross wall and said lower middle cross wall;

a pair of lower grooves, each of said lower grooves extending into a respective one of said side sections of said outer wall of said rail;

each of said side sections having a constant thickness wherein each of said lower grooves defines a corresponding lower interior ridge within said hollow interior; and each of said lower interior ridges being positioned coplanar with said bottom cross wall.

12. A fence rail device comprising:

a rail, said rail having a first end and a second end, said rail being elongated between said first end and said second end, said rail comprising an outer wall defining a hollow interior extending between said first end and said second end, said outer wall having a top section, a pair of side sections, and a bottom section, said side sections being parallel to each other, said side sections being substantially planar;

a slot extending through said bottom section between said first end and said second end;

a plurality of cross walls, each of said cross walls being planar, each of said cross walls extending between said side sections, said plurality of cross walls including a top cross wall, a middle cross wall, and a bottom cross wall, said top cross wall being spaced from said top section of said outer wall to define a top interior space within said outer wall, said bottom cross wall being spaced from said bottom section to define a bottom interior space, said middle cross wall being positioned between said top cross wall and said bottom cross wall to define an upper middle interior space above said middle cross wall and a lower middle interior space below said middle cross wall, said middle cross wall being positioned closer to said bottom cross wall than said top cross wall;

a pair of lower interior walls, each of said lower interior walls being coupled to and extending between said bottom section and said bottom cross wall, each of said lower interior walls being positioned proximate to a respective one of said side sections, each of said lower interior walls being aligned with and defining a respective lateral side of said slot;

a pair of medial interior walls, each of said medial interior walls being coupled to and extending between said bottom cross wall and said lower middle cross wall;

a distance between said medial interior walls being less than a distance between said lower interior walls;

a pair of upper grooves, each of said upper grooves extending into a respective one of said side sections of said outer wall of said rail, each of said side sections having a constant thickness wherein each of said upper grooves defines a corresponding upper interior ridge within said hollow interior, each of said upper interior ridges being coplanar with said top cross wail;

a pair of lower grooves, each of said lower grooves extending into a respective one of said side sections of said outer wall of said rail, each of said side sections having a constant thickness wherein each of said lower grooves defines a corresponding lower interior ridge within said hollow interior, each of said lower interior ridges being positioned coplanar with said bottom cross wall;

a pair of dividers, each of said dividers being coupled to and extending between a respective one of said lower interior walls and a respective one of said side sections to divide said bottom interior space on opposite sides of said slot into respective upper portions and lower portions;

a pair of upper slot ridges, each of said upper slot ridges extending from a respective one of said lower interior walls into said slot;

a pair of lower slot ridges, each of said lower slot ridges extending from a respective one of said tower interior walls into said slot; and a distance between said top cross wall and said top section being less than a distance between said bottom cross wall and said bottom section.

* * * * *